US006241423B1

(12) United States Patent
Thomas

(10) Patent No.: US 6,241,423 B1
(45) Date of Patent: Jun. 5, 2001

(54) LINING OF LANDFILL SITES

(75) Inventor: Frederick William Thomas, Saint Brelade (GB)

(73) Assignee: Woodman IP Holdings Limited, Jersey (GB)

( * ) Notice: Subject to any disclaimer, the term of this patent is extended or adjusted under 35 U.S.C. 154(b) by 0 days.

(21) Appl. No.: 09/202,938

(22) PCT Filed: Jun. 25, 1997

(86) PCT No.: PCT/GB97/01692

§ 371 Date: Mar. 1, 1999

§ 102(e) Date: Mar. 1, 1999

(87) PCT Pub. No.: WO97/49873

PCT Pub. Date: Dec. 31, 1997

(30) Foreign Application Priority Data

Jun. 25, 1996 (GB) ..... 9613245

(51) Int. Cl.[7] ..... E02D 31/00
(52) U.S. Cl. ..... 405/129; 405/258
(58) Field of Search ..... 405/15, 16, 17, 405/258, 268, 270, 128, 129; 404/40

(56) References Cited

U.S. PATENT DOCUMENTS 953,051 * 3/1910 Muralt ..... 405/16
5,542,782 * 8/1996 Carter, Jr. et al. ..... 405/129
5,599,139 * 2/1997 Chewning et al. ..... 405/129
5,782,582 * 7/1998 Oliver et al. ..... 405/270

FOREIGN PATENT DOCUMENTS 25 03 630 8/1976 (DE) .
998745 * 9/1951 (FR) ..... 405/16
2 293 849 4/1996 (GB) .
287 511 2/1965 (NL) .

* cited by examiner

*Primary Examiner*—Eileen D. Lillis
*Assistant Examiner*—Frederick L. Lagman
(74) *Attorney, Agent, or Firm*—Finnegan, Henderson, Farabow, Garrett & Dunner, L.L.P.

(57) ABSTRACT

A landfill site is lined by attaching an impermeable line (90) to a support structure for the purpose of containing waste material and preventing substances from draining or being leached from the waste into the subsoil. The support structure comprises a plurality of substantially rectangular panels (10) with rolled edges (14, 15, 16, 17) and their corners removed. The panels are supported and located adjacent to the wall of the landfill site in a planar array by a plurality of bolts (30) which are connected to the wall of the landfill site and pass through the opening (32) constituted by the absent comers of the panels. Adjacent pairs of rolled edges of adjacent panels are engaged by respective elongate C-section linking strips (45) which connect the panels together in a manner which permits at least limited relative pivotal movement

10 Claims, 6 Drawing Sheets

LINING OF LANDFILL SITES

BACKGROUND OF THE INVENTION

This invention relates to the lining of landfill sites for receiving waste, and more particularly, but not exclusively, to provision of a support structure for a flexible impervious lining intended to contain the waste material and to prevent elements of that material from draining into or being leeched from the waste into the subsoil and water table.

Spent or disused quarries and other excavations are commonly used for tipping domestic and other waste. The sheer variety of material contained in such waste virtually ensures the presence of potentially environmentally damaging materials. There has for some years been increasing concern to prevent such potentially damaging materials either from draining from the tipped waste into the subsoil and further, or being leeched from the waste by rainfall to the same effect. Quarry and other excavation sites may or may not be in substantially impervious materials, but the tendency now of authorities responsible for environmental protection is not to rely on that and, whether the proposed landfill site is in impervious material or not, to require provision of an impervious lining at least along the base and up the side walls of tipped sites, and in some cases for that lining to be completed by a sealed impervious cap so as totally to enclose the tipped material.

A variety of methods for lining a tipping site have been proposed. It is all but essential now for such lining to comprise a continuous flexible impervious lining produced by welding or otherwise affixing together discrete sheets of the lining material. Given the irregularity of the walls and base of most landfill sites, it is generally not feasible simply to lay a flexible sheet or membrane in place and various methods have been proposed for provision of a stable substrate eg constructed out from the walls of a disused quarry, against which the flexible membrane can sit and be supported without concern over breach of the flexible material by interaction with it by the quarry face and/or the tipped waste. There are such methods which involve essentially building a fresh wall to the quarry for example using gabions containing rocks or the like, or by use of a rigid metal framework to which are attached sheets of expanded metal. The former has a number of disadvantages not least of which that it involves substantial incursion into the tipping volume available. The latter involves initial construction of an extensive and robust framework around the quarry wall and moreover can suffer problems with cutting of the flexible liner sheet by the proud edges of the slits of the expanded metal sheet.

It is an object of the present invention to provide a simpler, more effective and cheaper support construction for a flexible impervious lining of a landfill or tipping site such as a quarry.

It will be appreciated in this specification that references to quarries are not, unless the context is to the contrary, intended to be restricted to quarry sites themselves and can refer equally to other excavated tipping sites or even naturally occurring tipping sites.

SUMMARY OF THE INVENTION

According to the present invention a support structure for lining a landfill site comprises:

(i) a plurality of substantially rigid panels with rolled edges;

(ii) means to locate and support the plurality of panels side by side in a substantially planar array with the rolled edges of adjacent panels in close juxtaposition; and (iii) substantially C-section elongate linking strips arranged to engage around the adjacent rolled edges c-two adjacent panels and thereby to connect the panels together.

The term "rolled " when used herein in relation to an edge of the panels is used to define a edge having a channel along it, whether formed by rolling or folding or bending the panel edge over on itself, by affixing arcuate or chined flange(s) thereon or by any other suitable expedient.

The resulting channel may be formed eg by "rolling" the edge of the sheet through any appropriate angle. A 180 degree "roll" may suffice although a "roll" through a greater angle may provide greater location with the said elongate linking strips. If the channel is truly rolled then the edges of the panels are likely to be of arcuate shape. In practice, the channels are more likely to be formed by the processes commonly referred to as bending or folding and in this case it is convenient for the edges of the panels to have two or three substantially right angle bends. However, a lesser angle is also possible but the bend or rolling should be through at least 90° and in practice through at least about 120°.

The C-section of the elongate linking strips may likewise be formed to have two inwardly opposing facing channels along opposite edges formed by rolling or folding the edges of an elongate metallic strip over on themselves, by affixing arcuate or chined flange(s) thereon or by any other suitable expedient. In this event the channels in the linking strips will accommodate respective edges of adjacent panels which are thus connected together in the manner of a hinge, which permits relative rotation of the associated panels and thus ready adaption of the support structure to an uneven or undulating surface of the quarry wall against which the support structure is to be constructed. Additional strength is thus imparted to the structure.

The combination of the the rolled edges of the panels and of the linking strips provides an marked degree of stiffening and reinforcement to the panel array, as well as a means of articulated connection of adjacent panels. If flexibility of the panels is desired, e.g. to permit adaptation to an unusually uneven quarry wall, at least certain of the rolled edges may have a gap or discontinuity in them.

The panels are preferably configured to leave openings between adjacent panels, when they are assembled, for the location and support means. The panels are preferably rectangular with each corner removed, whereby substantially quadrilateral openings are defined between adjacent panels, when the panels are assembled, for the location and support means. Each panel may be provided with means to attach a flexible impermeable liner thereto.

The invention also embraces a support structure of the type referred to above in situ in a landfill site in which the panels are located and supported side by side in a substantially planar array by the locating and support means and adjacent pairs of rolled edges of adjacent panels are connected together by respective linking strips and in which the locating and support means are affixed to the wall of a landfill site or to a substantially vertical framework extending from the base of the landfill site. The location and support means preferably comprises rods or bolts protruding from the wall of the landfill site or from the framework. The rods or bolts preferably extend through and are affixed to the panels at the periphery of the openings defined between them.

In the preferred embodiment each rod or bolt carries an abutment, e.g. in the form of a plate, which is engaged by one side of the panels defining the opening through which the rod or bolt extends, retaining means, e.g. in the form of a retaining plate, engaging the other side of the said panels and a fastener holding the retaining plate in position, e.g. a nut screw threaded onto the bolt.

The invention also embraces a lining for a landfill site comprising a support structure as referred to above and a flexible impermeable liner supported thereby.

The invention also embraces a method of constructing a support structure for a lining for a landfill site comprising:

(i) affixing location and support means to the wall of the landfill site or to a substantially vertical framework extending from the base of the landfill site, (ii) aligning and affixing panels to and between the location and support means in a substantially planar array, the panels each having rolled edges, each rolled edge being located adjacent a rolled edge of an adjacent panel in the array, and (iii) connecting adjacent rolled edges of adjacent panels by engaging substantially C-section elongate linking strips around them.

BRIEF DESCRIPTION OF THE DRAWINGS

The invention may be put into practice in various ways, some of which will now be described, by way of example, with reference to the accompanying diagrammatic drawings in which.

DETAILED DESCRIPTION OF THE INVENTION

Figure 1:
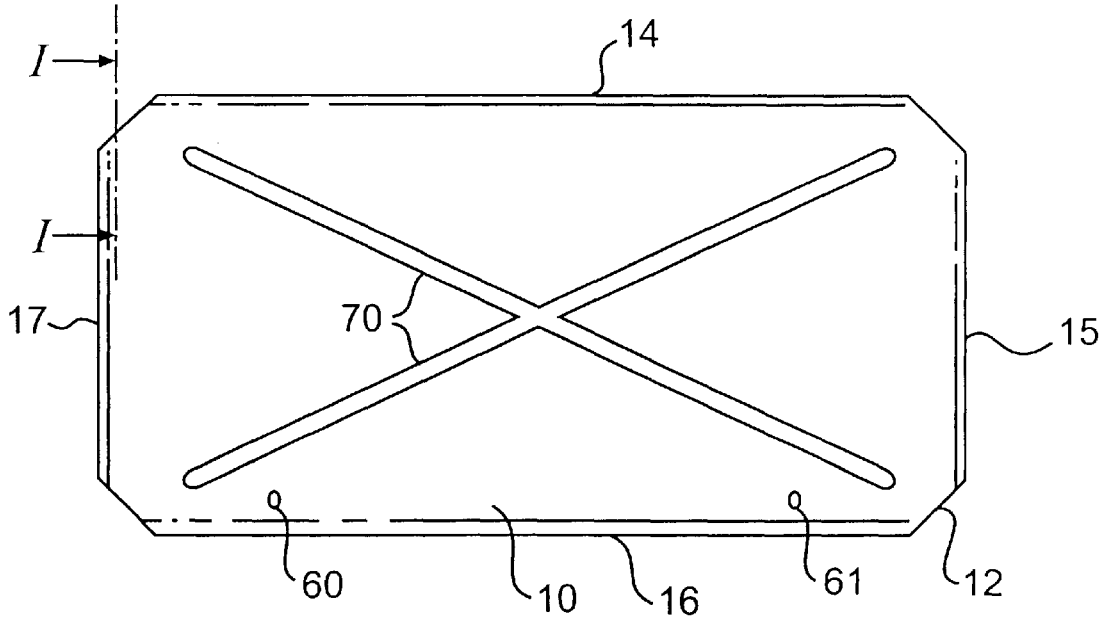
FIG. 1 is a plan view of a panel for use in constructing the support framework for a landfill site lining according to one aspect of the present invention.

Referring to the drawings, FIG. 1 shows a substantially rectangular panel 10 of mild steel sheet, galvanised or otherwise protected against corrosion. It is approximately 3 metres by 1.5 metres, though may be larger or smaller, e.g. 1 metre by 0.5 metre, and has its four corners 12 removed. Each of the edges (14 to 17) of the panel 10 is rolled as shown in section in FIG. 2, the rolled edges providing stiffening and reinforcement to the panel 10 and, as will be described below, a means of connection of adjacent panels 10 when disposed in a planar array against eg a quarry wall.

Figure 2:
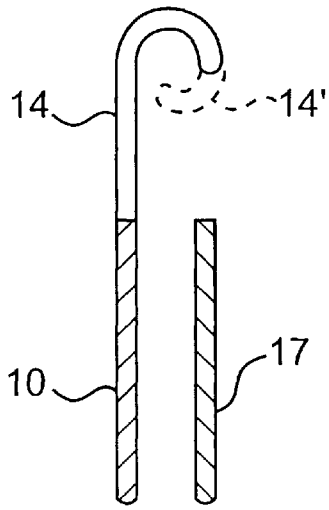
FIG. 2 is a scrap sectional view of a corner of the panel of FIG. 1 in the direction of the arrows I—I.

As shown in FIG. 2, the edge 14, and indeed the other three edges are rolled or otherwise bent through substantially 180°. However, as shown by the dotted portion 14', the edge may be rolled through a larger angle of e.g. 270° which will result in a greater degree of location with linking strips 45 (see below). In alternative embodiments each edge of the panel may be formed into a channel of equivalent effect eg by bending or folding the panel edge over on itself, by affixing arcuate or chined flange(s) thereon or by any other suitable expedient.

The panel 10 is provided with impressed corrugations 20 to provide further reinforcement. The corrugations 20 in this embodiment are substantially diagonal but can be of any structurally sound and effective disposition.

Figure 3A:
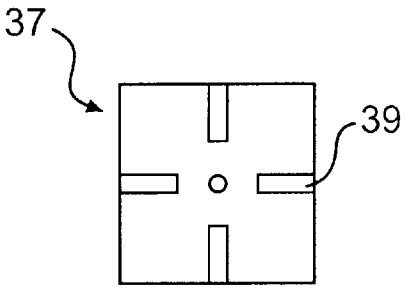
FIG. 3A shows a detail variation of a clamping plate in FIG. 3.
Figure 3:
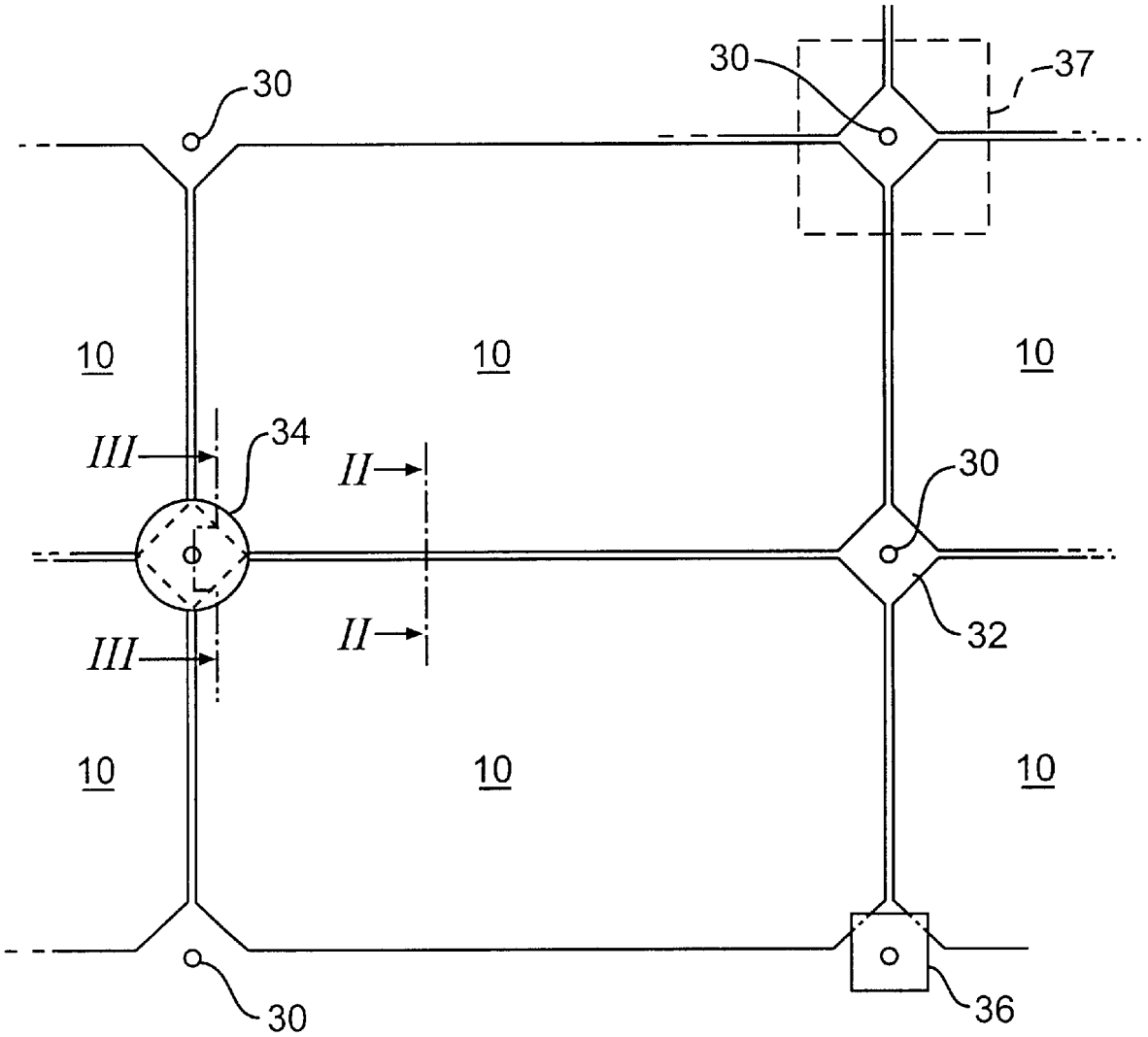
FIG. 3 is a view of an assembly of panels as shown in FIG. 1 located against eg a quarry wall (not shown)
Figure 5:
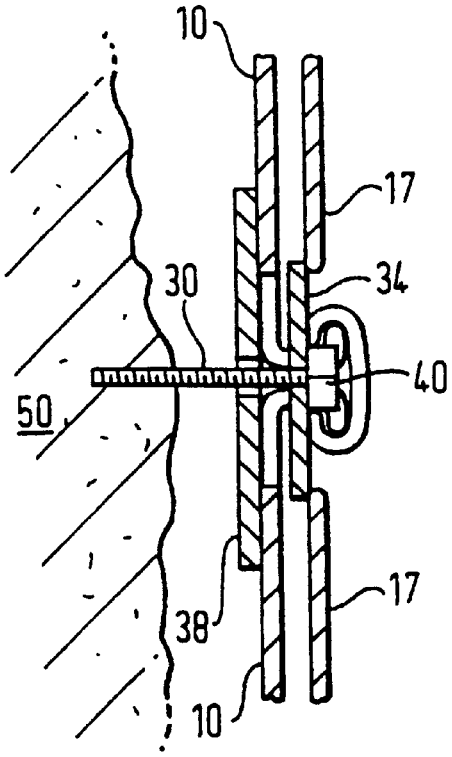
FIG. 5 is a further scrap sectional view in the direction of the arrows III—III of FIG. 3 through a connection of the panel array to eg a quarry wall behind.

FIG. 3 shows an array of panels 10 located with their edges adjacent to one another. In this view the array would normally be vertical or substantially vertically disposed up against the wall of the quarry or like landfill site. The wall of the landfill site is first prepared by affixing to it a pattern of mounting rods or bolts 30 each of which protrudes from the wall (not shown in FIG. 3 —but see FIG. 5) to a degree sufficient to pass through the intended plane of location of the array of panels 10 at that point.

The absence of corners 12 from each panel 10 creates a substantially square recess or opening 32 at each point where four panels 10 meet. The panels 10 are arranged so that a rod or bolt 30 affixed to eg the quarry face protrudes through each recess 32. Means to locate and optionally clamp the array of panels 10 to each rod or bolt 30 are provided. Each rod or bolt 30 is provided with a rear locating washer or plate 38 affixed eg by welding onto the rod or on a thread to an appropriate position behind the plane in which the panel array is to be located. The rear locating washer may be of a shape and area substantially exceeding that of the recess 32 to provide a stable base on which the panels 10 may sit. A round washer 34 of a diameter sufficient to extend over the edges of each removed corner 12 is used to clamp the four panels to the plate 38. Alternatively a square washer 36 of similar dimensions to the recess 32 may be used located at roughly 45° to the recess 32 so that the corners of the square washer 36 overlay the corners 12 of the adjacent panels 10. That arrangement is shown in section at FIG. 5.

In a further form (see also FIG. 3A) a larger plate 37 may be provided to be located over the rod or bolt 30 to clamp the array of panels 10. The plate 37 may have pressed radial channels 39 to receive the edges of the panels proud of the surface of the panels 10 to allow the plate 37 to sit flush with the surfaces of the panels 10.

The panel array is then clamped between the washers or plates 38 and 34,36 or 37 for example by nut 40 threaded on to the bolt 30.

If required for further support of the panel, elements (not shown) may be affixed to the quarry face with intermediate rods or bolts 30 so that any excess pressure on the panels 10 from tipped waste will press the panels 10 onto the support elements rather than causing them to buckle or sag. The support elements may for example be rods with flanges affixed thereto parallel to the plane of the intended array of panels 10. This manner of further support, if provided, will optimally be located behind each panel 10 at approximately the intersection of the diagonals of the panel 10.

Figure 4:
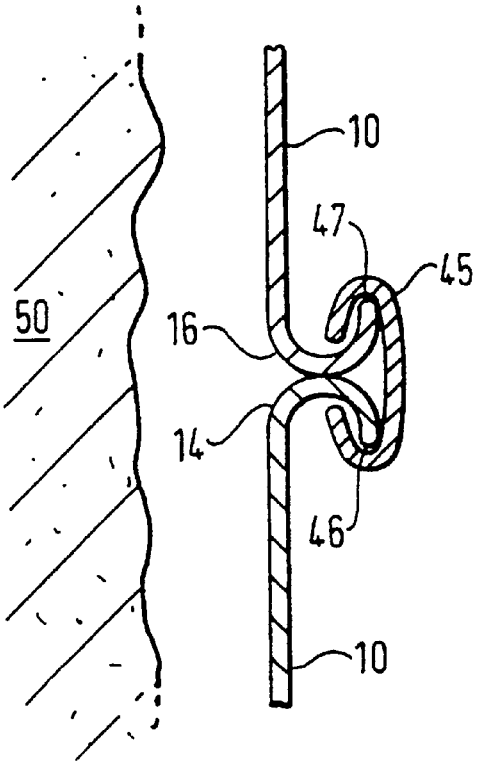
FIG. 4 is a scrap section along the line II—II of FIG. 3 showing the manner in which the panels are connected.

As already indicated the rolled edges 14 to 17 of each panel serve not only to reinforce the panel but also to provide a means for connecting together an array of panels as shown in FIG. 3. The section shown at FIG. 4 shows two adjacent panels 10 against a quarry face 50. The upper edge 14 of the lower panel 10 is adjacent to or abuts the lower edge 16 of the upper panel 10 and the whole array is held in place for example as described in relation to FIGS. 3 and 5 above.

A linking strip 45 is provided having a substantially C-shaped section. It may be made of the same mild steel, galvanised or otherwise protected, as the panels 10. A suitable length of the linking strip 45 is provided, either as a single strip or a number of shorter strips, preferably over the whole length of the rolled edges 14/16 of the adjacent panels 10, and is slid in place with the rolled edges 14 and 16 of the panels 10 being received in the opposing channels 46 and 47 of the linking strip 45 thereby locking the adjacent panels 10 to one another. Corresponding strips 45 would be provided at the vertical edges 15 and 17 of each panels 10 and as the array of panels 10 is built up using the bolt 30, washers or plates 38 and 34, 36 or 37 and linking strip 45 arrangement a rigid support structure is produced affixed to the quarry wall 50.

In areas where the quarry wall is not capable of supporting bolts 30 or the like, or where an array of support panels 10 is required to be free standing for example to section off an area of an excavation site, then a freestanding framework (not shown) may be provided for attachment of the bolts 30 or the like, the free-standing framework either being built up from the quarry floor or being affixed to any stable area of the quarry wall 50 adjacent to the point or points at which bolts 30 or the like are required to be located to support the array of panels 10.

In a further embodiment of the invention the array of panels 10 may be located such that the lower run of panels 10 is not located vertically but is located at an angle of say 45° to the quarry base to provide in effect a chamfer in section and thereby avoid the need for the flexible impermeable membrane sheet (see below) to have to bridge right angled corners. In that case the upper bolts 30 to locate the lower level of panels 10 would be located rather closer to the base of the quarry. A further line of bolts 30 or the like may also be required to be located in the quarry base approximately 0.75 metres from the plane of the array of panels 10 to affix the bottom panel at the desired eg 45° angle.

The intention of the constructed array of panels 10 is to support a conventional flexible impervious synthetic liner. For obvious reasons the lining material will be provided in discreet sheets or areas along the support array of panels 10 and adjacent, and preferably overlapping, sheets of the liner material will be welded or otherwise affixed to one another in the conventional manner.

Figure 6:
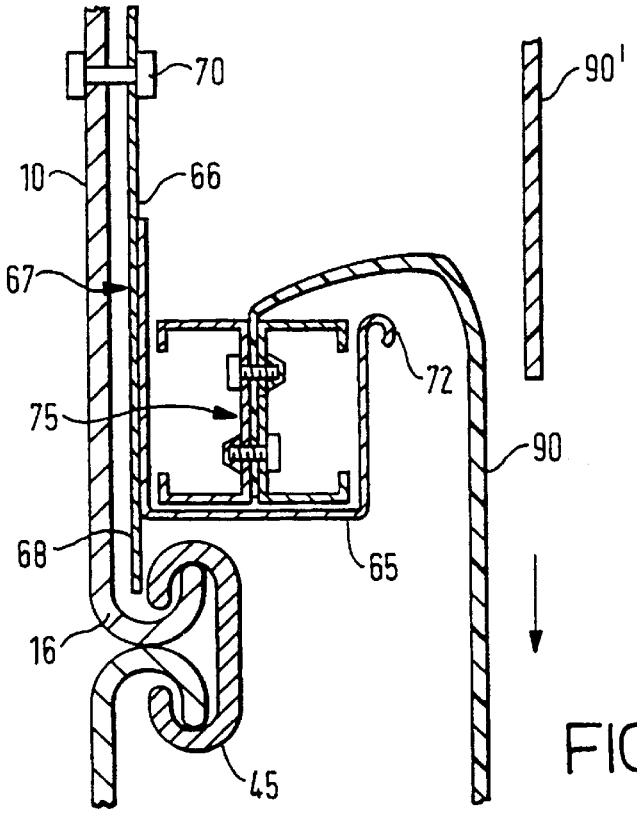
FIG. 6 is a sectional view of a joint between two adjacent panels showing one form of means to affix a flexible impervious lining sheet thereto.

Once the support structure provided by the array of panel 10 is in place either against the quarry or the like wall or supported by a free standing framework, a liner of suitable impervious flexible sheeting needs to be affixed to the array of panels 10. In this embodiment each of the panels 10 is provided near an edge 16 with fixing points 60/61, for example keyhole arrangements. As shown in FIG. 6, a channel member 65 is provided in a length corresponding to the horizontal dimension of panel 10, as shown in FIG. 1, and the channel member 65 has affixed along its length a plate 67 which protrudes above the channel member 65 at 66 and below channel member 65 at 68. The protrusion 66 of the plate 67 is provided with means to attach the channel and plate assembly 65/67 to a panel 10 by use eg of a key arrangement 70 which engages with a corresponding fixing point 60/61 on the panel 10. The protrusion 68 beneath the channel member 65 extends down into the rolled lower edge 16 of the panel 10. The arrangement thereby produces a channel running adjacent to the bottom rolled edge 16 firmly affixed to the panel 10. The channel member 65 itself has a rolled front edge 72 for reasons which will become apparent below.

Next there is provided a double channel clamping member 75 made up of two C-section linear channels 77 and 79 which can be bolted or otherwise affixed together by bolts or other fixings 80. It will be seen that the combination 75 of channel members 77 and 79 is arranged to fit stably into the channel member 65. In FIG.6, a flexible impervious membrane lining material 90 is fed between the channels 77 and 79 and the channel members 77 and 79 are clamped on to the liner 90 to secure the liner 90 between them. The clamp 75 is then dropped into the channel 65 and the membrane 90 arranged so that it lies along the rolled edge 72 of the channel member 65 and drops down over the face of the panel 10 or panels 10 below depending on the length of the membrane sheet 90. The next arrangement of a channel member 65 will be affixed to a lower row of panels 10 above the foot (not shown) of the membrane sheet 90 and the arrangement repeated. The lower end of the membrane sheet (equivalent to 90' in FIG. 6) can therefore be affixed (eg welded) where it overlaps with the equivalent but lower sheet 90 and thereby a waterproof lining to the landfill site can be built up.

Figure 7:
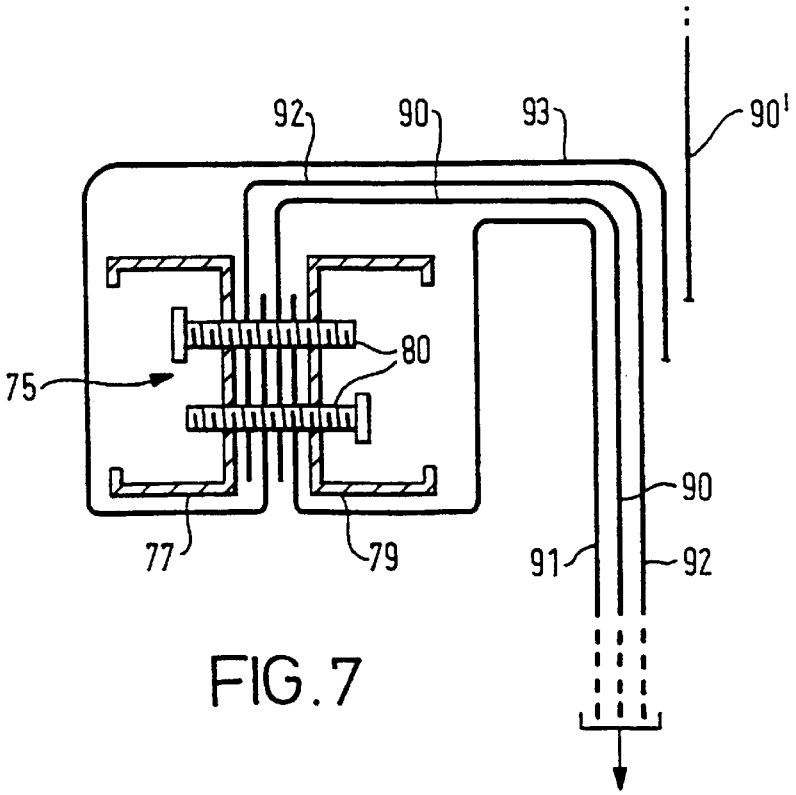
FIG. 7 is a sectional view of a further form of clamp used with the arrangement of FIG. 6 to affix a plurality of flexible impervious lining sheets to the panels.

FIG. 7 shows a modified version of the clamp 75 and membrane 90 arrangement to fit in channel 65 where it is felt that a compound lining may be required comprising a number of liners or membranes selected with their properties directed to waterproofing, scuff resistance, physical integrity or whatever. Three different liners or membranes 90, 91 and 92 are shown. Liner 90 is the flexible impervious liner as above. A protective membrane 91 is provided on the quarry side of membrane 90, with a further protective membrane 92 being provided on the waste side of membrane 90. The protective membranes 91 and 92 may be of "Gedtex" or similar protective material. With this multi-layer construction it will be apparent that the membrane 90' from the arrangement above that shown in FIG. 7 will in fact not contact membrane 90 for welding —there will be two layers of protective membrane 91/92 between them. To address this a further membrane 93 made of the same liner material as membrane 90 overlays membrane 92 to a depth sufficient only to provide a point of welding contact with membrane 90'. The four membranes 90/91/92/93 are clamped between the channel members 77 and 79 and passed in different routes around those channel members so that they can be overlaid in layers over the rolled edge 72 on the front of the clamp member 65.

With a single layer arrangement such as that shown in FIG. 6 the vertical, lateral, edges of the membranes 90 may overlap for welding together or a supplemental strip of suitable liner material may be welded in place to link adjacent drops of liner membranes 90. When a multi-layer liner arrangement, eg as shown in FIG. 7, is used essentially the same welding operation will be required, but for further protection she waste-side protective layers 93 of adjacent drops may be joined by a further strip of similar material by adhesion, clamping or "Velcro" to reduce the risk of damage to the liner sheet 90 between the adjacent drops of protective sheet 93.

Figure 8A:
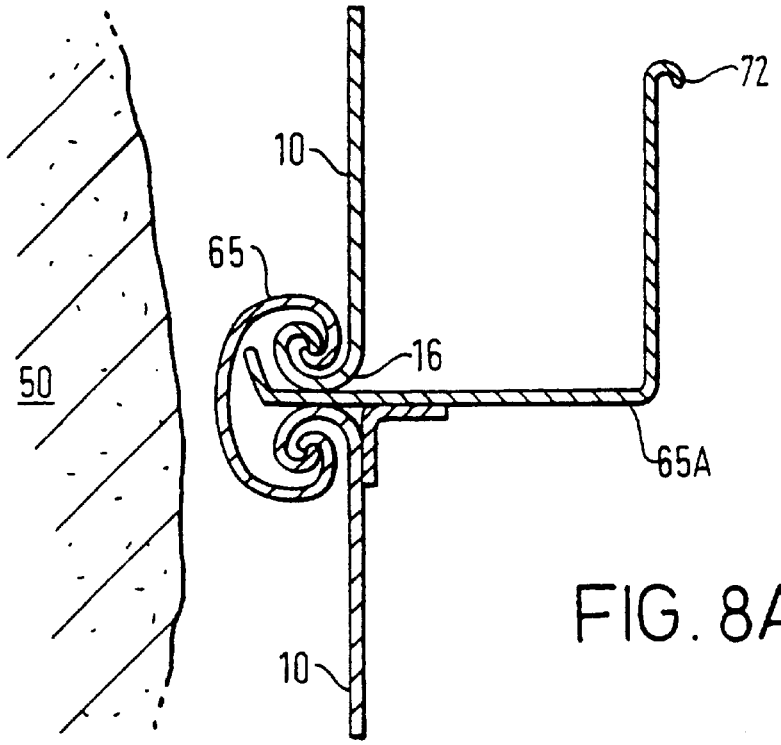
FIGS. 8A & B are scrap sections similar to FIG. 6 but of a further embodiment
Figure 8B:
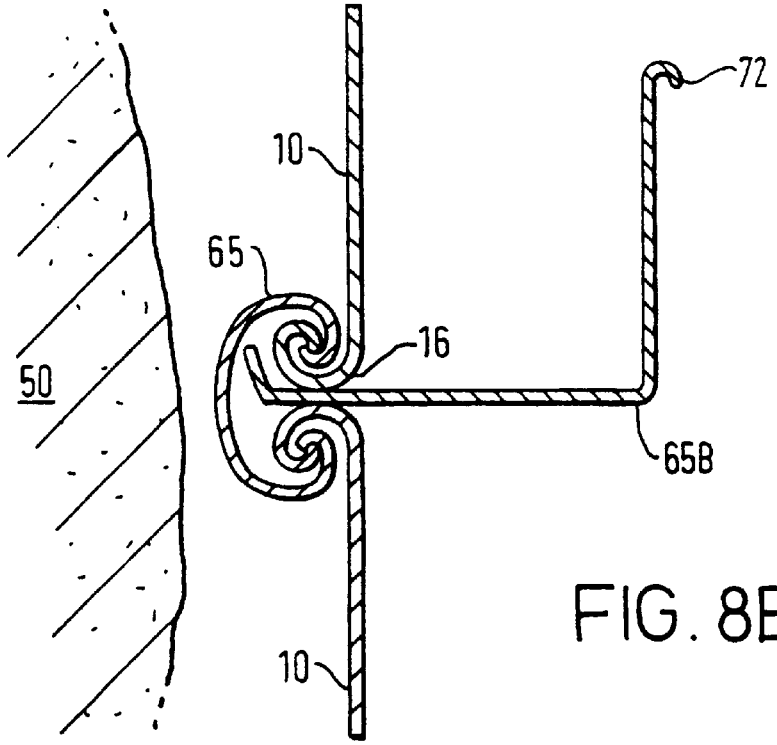

The various forms of the invention described above all have the "rolled" edges of the panels 10 facing the intended waste-side of the panels 10 in use. This facilitates assembly of the support structure but means that the liner will overlie the linking strips 45. This may well not constitute a problem, depending on the composition and thickness of the liner, because the linking strips present a relatively smooth surface and are thus unlikely to puncture the liner. However, if this is thought to be a potential problem, the problem may be eliminated by filling the rectangular spaces defined by the lining strips with lightweight panels, e.g. of polystyrene whose thickness is such that their surface opposed to the liner is substantially flush with that of the linking strips. However, FIGS. 8 A & B show an alternative arrangement of the panels 10 with their rolled edges 14 on the quarry-side of a panel array, in each case with a modified form of channel member 65A and 65B, and this of course also eliminates the potential problem referred to above in that this form of construction presents a smooth face to the inside (waste-side) of the quarry. In each case a linking strip 45 (not shown here) of suitable construction will be affixed over the edges of the adjacent panels 10 at the rear of the array.

Figure 9:
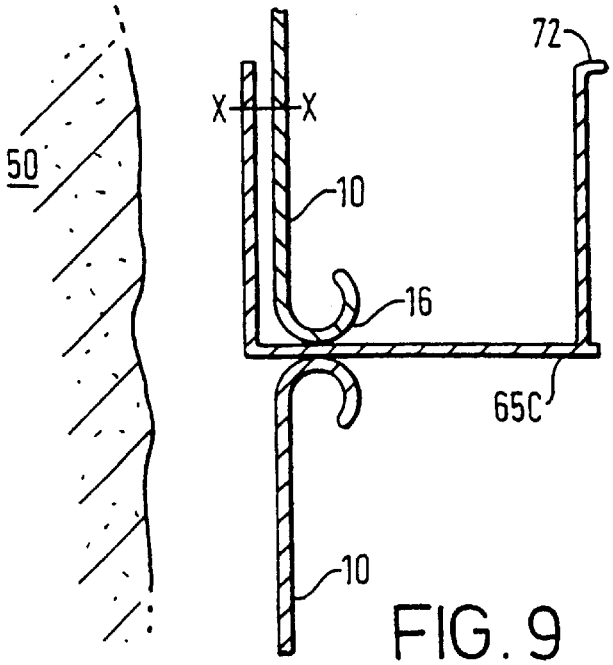
FIG. 9 is a scrap section similar to FIG. 6 but of a still further embodiment

FIG. 9 shows a further modified form of channel member 65C using an arrangement of panels 10 having their "rolled" edges facing the intended waste-side of the quarry. It will be appreciated that either the linking strip 45 (not shown) or the modified channel member 65C must be interrupted along the length of a panel 10 for this to work.

The channel member 65 and plate 66, and the channel members 77 and 79 making up the clamp member 75 may be made in the same materials as the panels 10 and linking strips 45, again suitably protected against corrosion.

If required, a stabilising or cover strip may be bolted or welded over the channel member 65 (or 65A, B) to ensure that the clamping member 75 and its membrane sheet load remain in place and protected.

Figure 10:
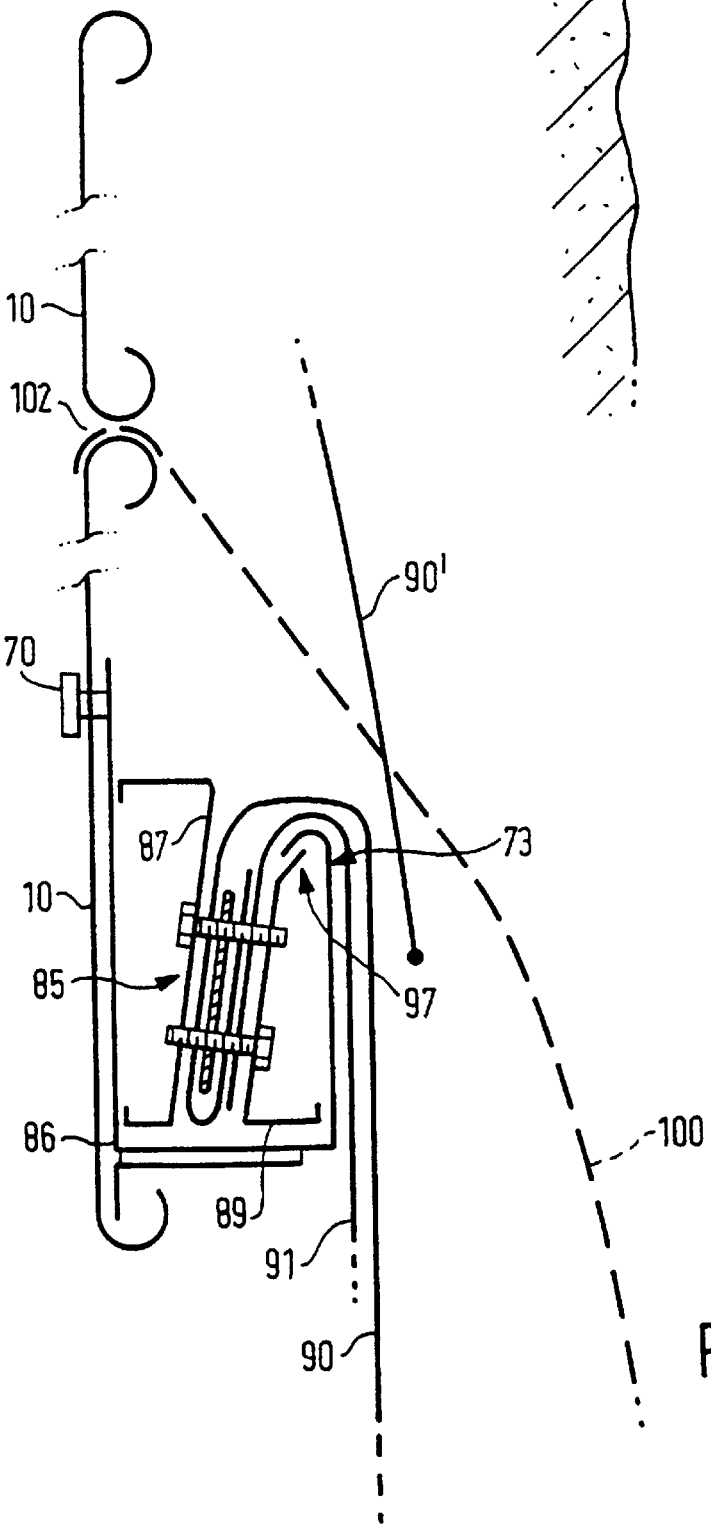
FIG. 10 shows a further embodiment of a liner support and liner

FIG. 10 shows a modified arrangement of liner. support and liner which uses a channel member 86 of similar construction to channel member 65 of eg FIG. 6, but with its front edge 73 rolled inward rather than outward as at 72. The clamp member 85 differs from previously described clamp member 75 in that its central clamping walls are at an angle of about 75 degrees to the "horizontal" plane as shown in the drawing. The outer element 89 of the clamping member 85 has its upper edge 97 at a position such that, with the clamping member 85 in place in the channel member 86 as shown, the upper edge 97 snap-fits under the inward rolled front edge 73 to lock the clamping member in place.

The liner 90, or multi-layer lining arrangement used in this embodiment, may take any appropriate form. The arrangement shown in FIG. 9 has a protective membrane 91 on the quarry-side of a flexible impervious liner 90. A further membrane 100 of protective material is suspended temporarily from a fixing at 102 at the top of the panel 10 supporting the clamping member 85 and its membranes 90/91. As the infill of waste (or a reinforcing wall of gabions if required) rises, the lower reaches of the membrane 100 will be clamped in place against the liner membrane 90, its upper reaches being overlaid in turn by a next membrane 100' (not shown). This may involve part of the membrane 100 or its support at 102 being discarded once the waste etc reaches a certain level.

It will be appreciated that the support structure is unlikely to extend truly vertically and in practice it is likely to extend somewhat rearwardly. This is not of itself a problem but does means that where e.g. the rear and side walls meet there is likely to be an upwardly diverging gap. This can be readily accommodated by using linking strips of upwardly increasing or decreasing width or inserting panels of upwardly increasing or decreasing width at that point or by covering the gap by galvanised plates affixed by welding, rivetting or otherwise.

What is claimed is:

1. A support structure for lining a landfill site comprising:

(i) a plurality of substantially rigid panels with substantially straight edges, each edge being rolled;

(ii) means to locate and support the plurality of panels side by side and one above the other in a substantially planar array with the rolled edges of adjacent panels in close juxtaposition, the panels being configured to leave openings between adjacent panels for the location and support means;

(iii) substantially C-section elongate linking strips arranged to engage around the adjacent rolled edges of each two adjacent panels and thereby to connect the panels together.

2. A support structure as claimed in claim 1 in which the panels are substantially rectangular and each corner of the panels is removed to leave substantially quadrilateral openings between adjacent panels for the location and support means.

3. A support structure as claimed in claim 1 which each panel is provided with means to attach a flexible impermeable liner thereto.

4. A landfill including the support structure of any one of the preceding claims insitu in a landfill site in which the panels are located and supported side by side and one above the other in a substantially planar array by the locating and support means and adjacent pairs of rolled edges of adjacent panels are connected together by respective linking strips and in which the locating and support means are affixed to the wall of a landfill site or to a substantially vertical framework extending from the base of the landfill site and are received in the openings between adjacent panels.

5. A landfill as claimed in claim 4 in which the location and support means comprise rods or bolts protruding from the wall of the landfill site or from the framework.

6. A landfill as claimed in claim 5 in which the rods or bolts protruding from the landfill site wall or from the framework extend through and are affixed to the panels at the periphery of the openings defined between them.

7. A landfill as claimed in claim 6, in which each rod or bolt carries an abutment, which is engaged by one side of the panels defining the opening through which the rod or bolt extends, a retaining plate engaging the other side of the said panels and a fastening holding the retaining plate in position.

8. A lining for a landfill site comprising a landfill as claimed in claim 4 and a flexible impermeable liner supported thereby.

9. A method of constructing a support structure for a lining for a landfill site comprising:

(i) affixing location and support means to the wall of the landfill site or to a substantially vertical framework extending from the base of the landfill site;

(ii) aligning a plurality of substantially rigid panels side by side and one above the other in a substantially planar array, the panels having substantially straight edges and being configured to leave openings between them and each edge of the panels being rolled, each rolled edge being located adjacent a rolled edge of an adjacent panel in the array, the location and support means being received in the openings between the panels;

(iii) affixing the aligning and support means to the panels; and (iv) connecting adjacent rolled edges of adjacent panels by engaging substantially C-section elongate linking strips around them.

10. A method of constructing a support structure lining for a landfill site comprising constructing a support structure as claimed in claim 9 and affixing a flexible impermeable liner thereto.

* * * * *